US006741159B1

(12) United States Patent
Kuczynski

(10) Patent No.: US 6,741,159 B1
(45) Date of Patent: May 25, 2004

(54) FAIL-SAFE ASSEMBLY FOR COACTING CONTACTS IN A CURRENT-CARRYING SYSTEM, APPARATUS OR COMPONENT

(76) Inventor: Robert A. Kuczynski, 520 Springfield Ave., Westfield, NJ (US) 07090

( * ) Notice: Subject to any disclaimer, the term of this patent is extended or adjusted under 35 U.S.C. 154(b) by 5 days.

(21) Appl. No.: 10/147,167

(22) Filed: May 16, 2002

(51) Int. Cl.[7] ..... H01H 37/32; H01H 37/02

(52) U.S. Cl. ..... 337/403; 337/401; 337/142; 337/150

(58) Field of Search ..... 337/36, 142, 150, 337/154, 401–407, 417

(56) References Cited

U.S. PATENT DOCUMENTS

| | | | | | |
|---|---|---|---|---|---|
| 3,611,235 | A | | 10/1971 | Rose | |
| 3,827,014 | A | * | 7/1974 | Wehl | 337/407 |
| 4,135,177 | A | * | 1/1979 | Kelley et al. | 337/407 |
| 4,186,366 | A | * | 1/1980 | McVey | 337/407 |
| 4,276,531 | A | * | 6/1981 | Davis | 337/407 |
| 4,295,114 | A | | 10/1981 | Pohl | |
| 4,313,047 | A | | 1/1982 | Cox et al. | |
| 4,352,082 | A | * | 9/1982 | Barry et al. | 337/409 |
| 4,360,725 | A | | 11/1982 | Eeckhout | |
| 4,400,677 | A | | 8/1983 | Cobb, III et al. | |
| 4,451,814 | A | * | 5/1984 | Barry et al. | 337/407 |
| 4,472,705 | A | | 9/1984 | Carlson | |
| 4,527,144 | A | * | 7/1985 | Arikawa | 337/407 |
| 4,876,523 | A | | 10/1989 | Kushida et al. | |
| 4,885,560 | A | | 12/1989 | Niino | |
| 4,929,922 | A | * | 5/1990 | Hollweck | 337/407 |
| 5,014,036 | A | * | 5/1991 | Komoto | 337/407 |
| 5,159,309 | A | * | 10/1992 | Bayer | 337/402 |
| 5,831,507 | A | * | 11/1998 | Kasamatsu et al. | 337/4 |
| 6,239,686 | B1 | * | 5/2001 | Eder et al. | 337/382 |
| 6,583,711 | B2 | * | 6/2003 | Yang | 337/394 |

* cited by examiner

*Primary Examiner*—Anatoly Vortman
(74) *Attorney, Agent, or Firm*—Lerner, David, Littenberg, Krumholz & Mentlik, LLP

(57) ABSTRACT

A fail-safe assembly for an electronic or electrical component, device, system or apparatus with coacting operatively associated contacts has an impact member, normally maintained in a stressed and disengaged portion, and a meltable or fusible member for holding and for actuating the release of the impact member to guard against the danger of fire and damage due to current overload and/or unacceptable increases in the temperature in the current-carrying members for operating the coacting contacts or the ambient temperature for any reason and assures, on melting of the meltable or fusible member, that there are sufficient forces created to open and maintain the coacting contacts in the open position.

34 Claims, 12 Drawing Sheets

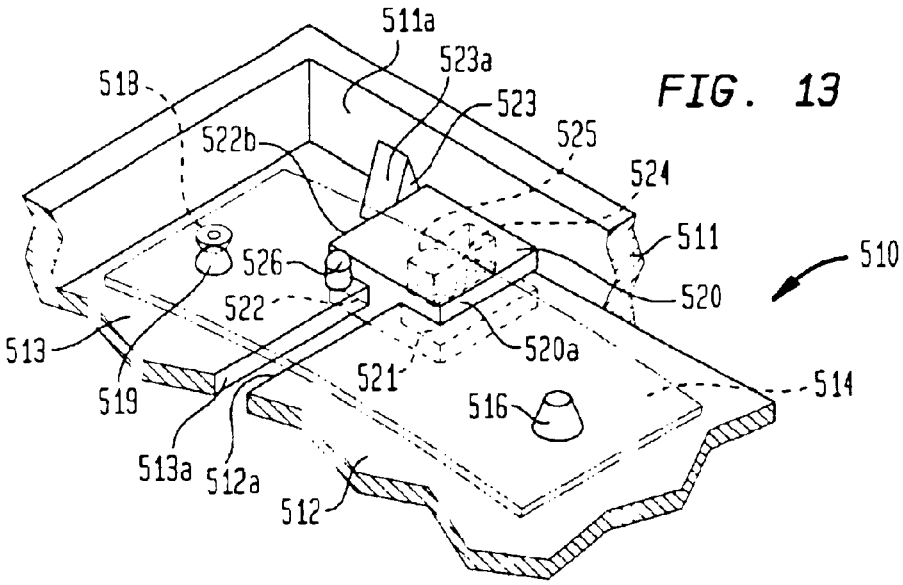
FIG. 13
FIG. 14A
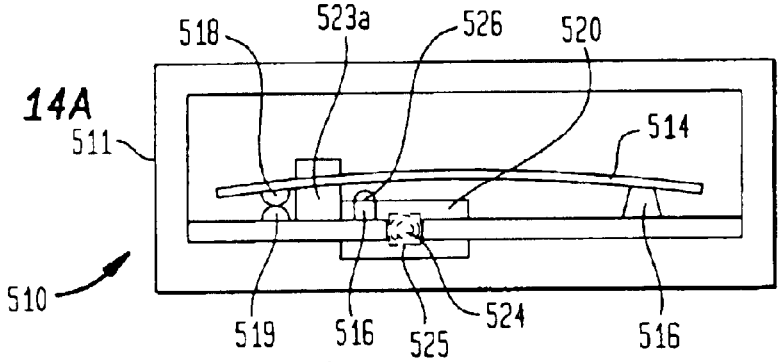
FIG. 14B
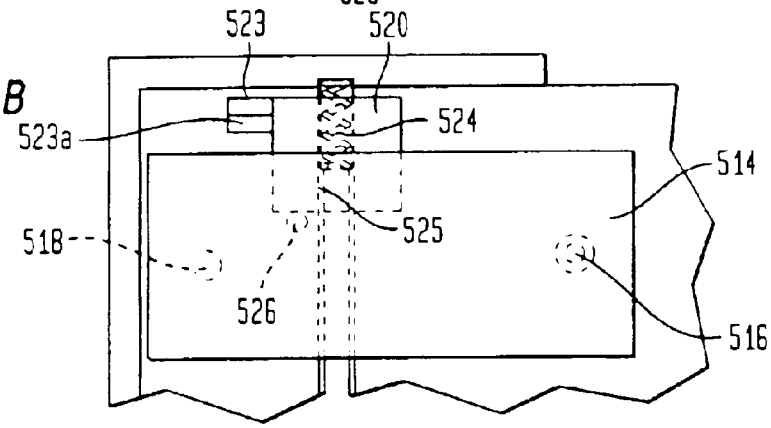
FIG. 14C
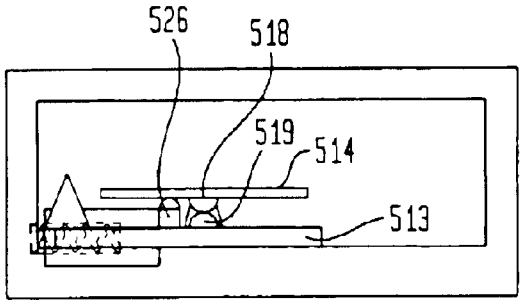

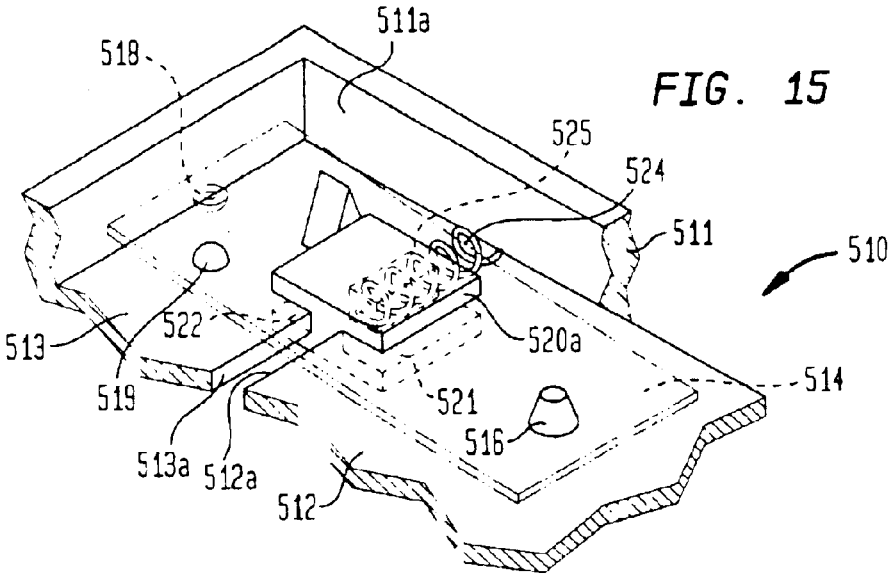
FIG. 15
FIG. 15A
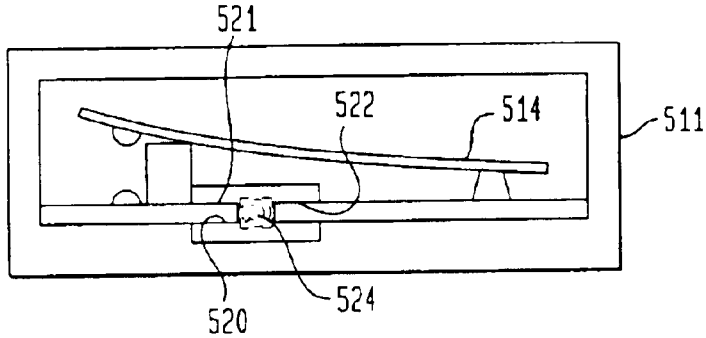
FIG. 15B
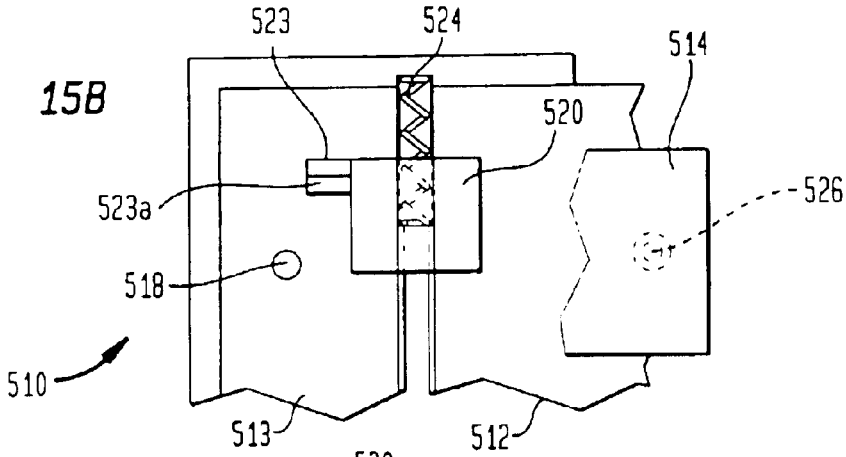
FIG. 15C
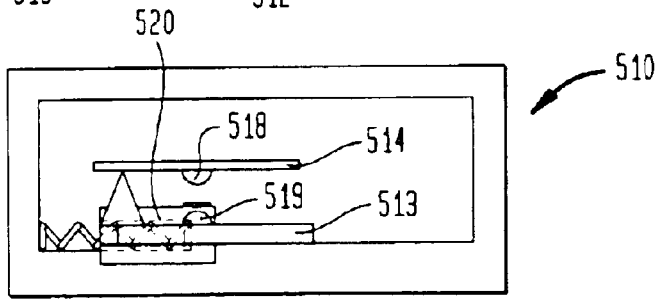

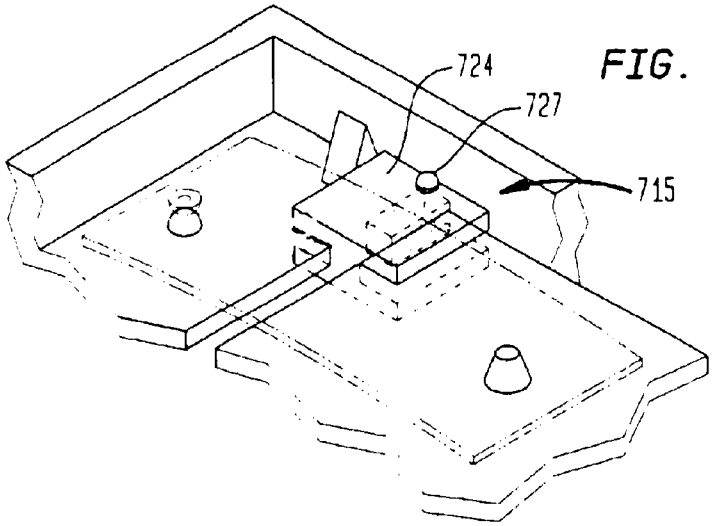
FIG. 19
FIG. 19A
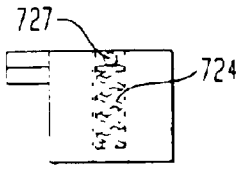
FIG. 19B
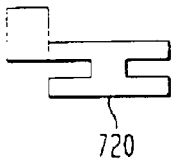
FIG. 19C
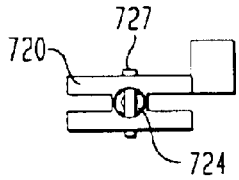
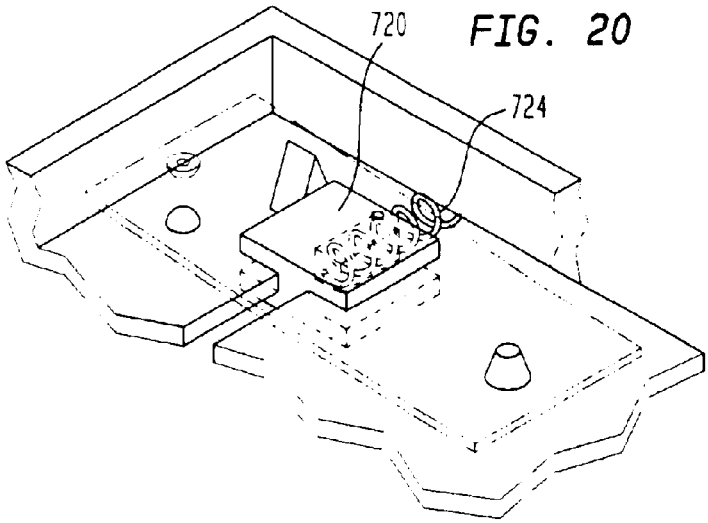
FIG. 20
FIG. 20A
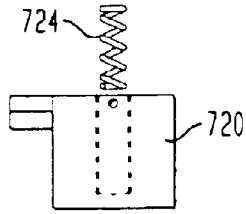

FAIL-SAFE ASSEMBLY FOR COACTING CONTACTS IN A CURRENT-CARRYING SYSTEM, APPARATUS OR COMPONENT

BACKGROUND OF THE INVENTION

This invention relates generally to a protective device or assembly for electrical current-carrying circuits and more particularly to a fail-safe assembly for the coacting contacts in electrical current-carrying systems, apparatus and electrical and electronic components and devices in which the fail-safe assembly includes an impact member or assembly, held in a stressed, inactive and disengaged position by a meltable material which melts as a function of the condition against which the fail-safe assembly is being used to safeguard and protect the system, apparatus, component or device. When the material melts or fuses, the stress forces of the impact member or assembly will act to impact either directly or indirectly the coacting contacts to move them to the open position and maintain them open.

The impact member or assembly is made of suitable materials and will be sized and shaped to produce the necessary impact forces to insure that the coacting contacts will open and remain open.

In electrical current-carrying circuits, electrical systems, electrical apparatus, electrical and electronic components and associated apparatus, the current flow therethrough is often controlled by coacting contacts, generally one fixed contact and at least one movable contact on a current-carrying movable arm, support or assembly which, when actuated, moves the movable contact into engagement with the fixed contact. The current-carrying movable arm, support or assembly is actuated as a function, for example, of the changes in ambient temperature, the temperature of the movable member or the current load in the system. While this general type of coacting contacts has been described, it will be clear that the present invention is equally applicable where both contacts are movable relative to each other.

Where there are coacting contacts in electrical current-carrying systems, apparatus, components and devices, dangerous conditions often arise, due to current overload or an unacceptable or generated rise in internal or external ambient temperature conditions, causing potentially fire or damage to the component, device, system or associated apparatus. Therefore, it is necessary to effectively guard against the danger of such fire and damage to the electrical or electronic component or device and the electrical system or apparatus in or with which the component is associated.

It is known in the prior art that certain thermal switches and circuit breakers include meltable or fusible assemblies or materials, as fail-safe or safeguard devices, serially connected in associated electrical current-carrying circuits or apparatus to prevent fire or damage. Such devices are shown in U.S. Pat. Nos. 3,611,235; 4,295,114; 4,360,725; 4,313,047; 4,400,677; 4,472,705; 4,885,560 and 4,876,523.

The device shown in U.S. Pat. No. 4,360,725 illustrates a temperature protector for an electrically heated appliance in which a torsion spring has a torsion arm normally held in a stressed position. Such torsion arm is operatively associated with a fusible restraining pin disposed with respect to the movable arm of a switch in the electrical circuit so that upon melting of the fusible pin, the torsion arm moves, thereby releasing the movable arm of the switch, so as to open the switch and the electrical circuit in which the bimetallic temperature protector is connected.

Other devices, such as the thermal relay shown in U.S. Pat. No. 4,885,560 and the thermo-switch shown in U.S. Pat. No. 4,295,114, disclose a fail-safe system whereby a fusible link is represented by a metal, meltable at a predetermined temperature. Upon melting of the fusible link, a spring-driven member acts to push the switch operating plate to an open position.

Another device used in the prior art to safeguard against the danger of fire and changes to the electrical or electronic component or device and the electrical system or apparatus in or with which such component or device is associated is a separate element in the form of a thermal fuse type member which is added in series by soldering, welding, riveting, crimping or attaching in a separate fuse holder which is temperature sensitive and permanently opens at a predetermined temperature setting.

These fail-safe assemblies add additional problems to electrical or electronic devices or components due to looseness, misalignment and high resistance adding to the difficulty in assembly, increasing the cost of manufacture and providing a less reliable apparatus.

In such prior art fail-safe devices, the absence of sufficient force upon melting of the restraining fail-safe or safeguard element does not assure that the fail-safe mechanism in the circuit breaker, thermal relay, thermo-switch and the like electrical devices will effectively create and maintain an open circuit condition in all situations, particularly those where a significant force is required to open the circuit, as in situations where worn contacts are partially welded together during adverse operating conditions.

SUMMARY OF THE INVENTION

Therefore, in one aspect of the present invention, improved fail-safe assemblies for such electrical devices are disclosed, utilizing an impact member, initially held from engagement with the operatively associated coacting contacts by a restraining meltable or fusible material, which impact member serves as a driving force. Upon melting of the restraining meltable or fusible material holding the impact member in the non-active or disengaged position, the impact member is released to engage and to hold the coacting contacts in non-contacting relationship, thereby creating and producing a controlled and certain fail-safe assembly.

It is another aspect of the present invention to provide a fail-safe assembly including a meltable or fusible member for an electronic or electrical component, device, system or apparatus with coacting operatively associated contacts which will effectively guard against the danger of fire and damage to the electronic or electrical component, device, system or apparatus as a result of an electrical current overload or increase of ambient temperature for any reason by assuring, upon melting of the meltable member or fusible link, that there is sufficient force created by the fail-safe system to open and maintain open the coacting contacts.

It is another aspect of the present invention to provide a fail-safe assembly including a meltable or fusible member for an electronic or electrical component, device, system or apparatus with coacting operatively associated contacts which will effectively guard against the danger of fire and damage to the electronic or electrical component, device, system or apparatus as a result of an electrical current overload or increase of ambient temperature for any reason by assuring, on melting of the meltable or fusible member, that there is sufficient force created in the fail-safe system to open and maintain open the coacting contacts so that the dangerous condition will not reoccur.

In another aspect of the present invention to provide a miniature bimetallic circuit breaker which effectively protects components, devices, systems and associated apparatus from damage that could result from overload and unacceptable increases in temperature having, a first current-carrying terminal and a second current-carrying terminal mounted in spaced relation to each other, a snap acting bimetallic actuator connected at one end to said first current-carrying terminal and having a contact at the end remote from the connected end, said second current-carrying terminal having a fixed contact formed thereon, and said movable arm or plate disposed to extend relative said second current-carrying terminal for operative engagement of the contact thereon with the fixed contact on said second current-carrying terminal, and a fail-safe assembly including an impact member disposed for engagement of sand bimetallic actuator, a meltable member normally maintaining the impact member out of engagement with the bimetallic actuator whereby, on melting of the meltable member, the stressed impact member is released with sufficient force to engage and hold the bimetallic actuator in an inoperative position.

It is another object of the present invention to provide an improved fail-safe assembly to guard against the danger of fire and damage in an electrical circuit for an electrical or electronic component, a current-carrying system or associated apparatus with coacting contacts including, an impact member capable of generating high-impact forces, a meltable member for normally maintaining the impact member under stressed conditions wherein on melting of the meltable member, said impact member will have sufficient force to open and maintain open the coacting contacts.

It is another object of the present invention to provide for use in an electrical circuit having a fail-safe assembly for safeguarding an electrical and electronic component, a current-carrying system or an associated apparatus from danger due to fire or other damage with a visual indicator to show when the fail-safe assembly has been actuated.

It is another object of the present invention to provide an electronic or electrical component, a current-carrying system or an associated apparatus with a fail-safe assembly including, an impact member, and a meltable or fusible member for safeguarding coacting operatively associated contacts therein which can be manufactured at a relatively low cost.

It is still another object of the present invention to provide in an electronic or electrical component a current-carrying system or an associated apparatus with a fail-safe assembly including an impact member and a meltable or fusible member for safeguarding coacting operatively associated contacts therein. The meltable or fusible member is sized and shaped as part of the housing or supporting structure which has softening and melting characteristics so that the impact member will be released by the melting action of the meltable or fusible member at a predetermined temperature.

BRIEF DESCRIPTION OF THE DRAWINGS

FIG. 13 shows a fragmentary perspective view of a portion of an electronic component or device with current-carrying terminals for slidably mounting still another embodiment of a fail-safe assembly having a slidable impact member in accordance with the present invention where the impact member is in the stressed and disengaged position.

FIG. 14A is a front view of the electronic component or device with current-carrying terminals for mounting the embodiment of the slidable fail-safe in accordance with the present invention as shown therein in the stressed and disengaged position.

FIG. 14B is a top plan view of the electronic component or device with the embodiment of the slidable fail-safe assembly shown in FIGS. 13 and 14A.

FIG. 14C is a side view of the electronic component or device with the embodiment of the slidable fail-safe assembly shown in FIGS. 13, 14A and 14B.

FIG. 15 is a fragmentary perspective view of the electronic or electrical component or device with the embodiment of the fail-safe assembly shown in FIG. 13 in the released and engaged position with the current-carrying movable arm for opening and maintaining open the coacting contacts of the electronic or electrical component.

FIG. 15A is a front view of the electronic or electrical component or device with embodiment of the fail-safe assembly as shown in FIG. 15 in the released and engaged position.

FIG. 15B is a top plan view of the electronic component or device with the embodiment of the fail-safe assembly as shown in FIGS. 15 and 15B in the released and engaged position.

FIG. 15C is a side view of the electronic component or device with the embodiment of the fail-safe assembly as shown in FIGS. 15, 15A and 15B in the released and, engaged position.

FIG. 19 is a perspective view of a still further embodiment of the impact member of a fail-safe assembly as in the embodiments shown at FIGS. 13 and 16 of the drawings where the impact member is held in the stressed or disengaged position.

FIG. 19A is a top plan view of the impact member of the embodiment of the fail-safe assembly shown at FIG. 19 of the drawing showing the mechanism for holding the impact member in the stressed and disengaged position.

FIG. 19B is a front view of the impact member shown in FIGS. 19 and 19A.

FIG. 19C is a back view of the impact member shown in FIGS. 19, 19A and 19B.

FIG. 20 is, a perspective view of the embodiment of the impact member shown in FIG. 19 where the impact member is in the released or engaged position.

FIG. 20A is a top exploded view of the impact member shown in FIG. 20.

DETAILED DESCRIPTION

Figure 1:
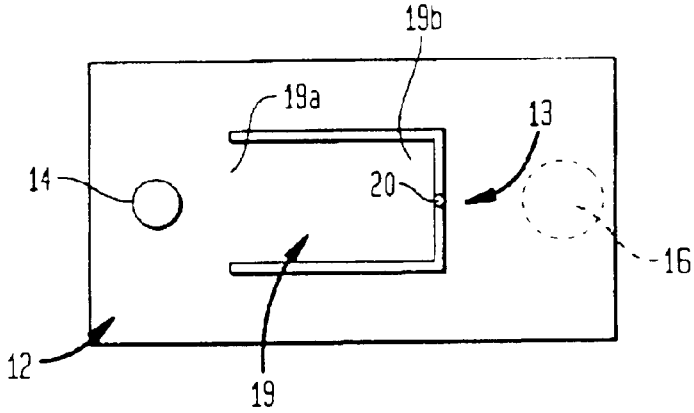
FIGS. 1, 2 and 3 show a top view and side views of a fragmentary portion of an electronic or electrical component or device including and showing one embodiment of a fail-safe assembly in accordance with the present invention wherein the impact member is in the stressed and disengaged position and the released and engaged position.
Figure 2:
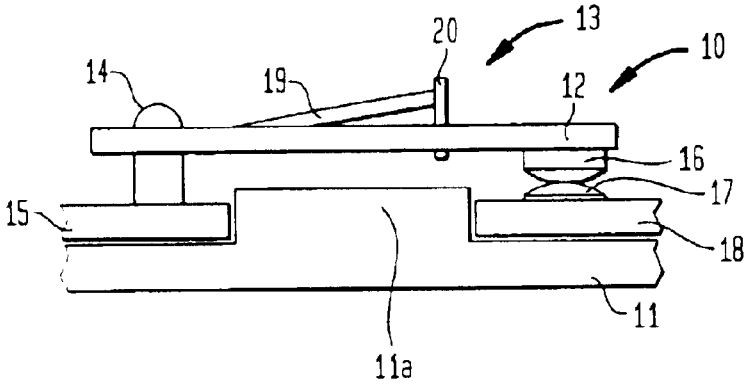
Figure 3:
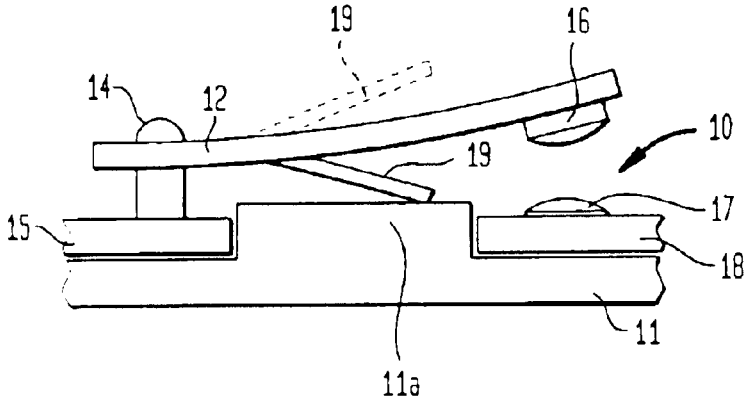

Referring to FIGS. 1, 2 and 3, a fragment of an electronic or electrical component or device generally designated 10 having a housing 11 is shown with a current-carrying movable arm or plate 12 mounted therein operatively associated with a fail-safe assembly 13 in accordance with the present invention.

Movable arm or plate 12 is a generally elongated member and may take many forms depending on the embodiment of the fail-safe assembly 13 illustrated. It can be made of many types of current-conducting material and resilient and non-resilient forms of materials. For example, the movable arm or plate 12 may be in the form of a bimetallic plate which has two different metallic members formed together so that the differential expansion with change in temperature will cause the movable arm or plate 12 to move or bend into an arc as a function of the degree of the differential expansion of the combined metallic elements. These devices are well known by those skilled in the art, particularly for use in electrical and electronic devices and circuits for actuating coacting contacts. Such bimetallic members are easily purchasable and available on the open market and hence will not be more fully described because they are well known to those skilled in the electrical and electronic art and industries.

Then, when a current-carrying movable arm is used in the present application, it is intended to include such bimetallic plates and their method of operation and any other current-carrying elongated members without departing from the scope of the present invention. Those skilled in the art, however, will also recognize that the embodiments of the invention, as hereinafter described, work well with bimetallic plates as he form of the -movable arm illustrated.

In the electronic or electrical component or device 10, the elongated current-carrying movable arm or plate 12 is connected as at 14 to a first current-carrying terminal 15 connected and communicating with one side of an electrical circuit, not shown. At the end remote from the connected end 14, the movable arm or plate is provided with a contact 16 on the lower face thereof. This contact 16 is movable with the remote end of the movable arm or plate 12 when the movable arm or plate is caused to move or bend with changes in current and/or temperature either in the plate or the ambient atmosphere in the housing 11. Elongated movable arm or plate 12 so extends through the housing 11 that in assembled position the movable contact 16 is aligned to contact with a second or fixed contact 17 connected and mounted on a second current-carrying terminal 18 disposed a spaced distance from the first current-carrying member 14, and communicating with the opposite side of electrical circuit, not shown, in which the electronic or electrical component or device 11 is connected, all of which is shown in FIGS. 1, 2 and 3 of the drawings.

Thus, when the movable arm or plate 12 is caused to move due to changes in current and/or temperature either in the movable arm or plate or in the ambient atmosphere in the housing, the movable contact 16 coacts with the fixed contact 17 to permit or stop flow of current through the electronic component or device 10.

In the event of a dangerous current overload or increase in the exterior or interior ambient temperature for any reason, and the coacting operatively associated movable contact 16 and fixed contact 17 are caused to stick together or weld together due to arcing or other conditions common in various types of electrical circuits, the fail-safe assembly 13 will be actuated. Fail-safe assembly 13 will move and hold or latch the coacting movable contact 16 and fixed contact 17 into the open position and maintain it in the open position so that current flow from the associated electrical circuit or in an associated system or apparatus will be terminated and the potential for a dangerous fire or of other damage will be avoided or terminated.

Thus, referring further to FIGS. 1, 2 and 3 in this embodiment of the invention, fail-safe assembly 13 has an elongated leaf spring-type impact member 19 formed integrally with and in the movable arm or plate 12 and aligned so that it will be movable relative the medial section of the movable arm or plate 12. The impact member 19 has a fixed end 19*a* near the connected end 14 of the movable arm or plate 12 and a free end 19*b* remote therefrom facing the movable contact 16. The fail-safe assembly 13 also includes a meltable pin 20 so connected between the free end 19*b* of the impact member 19 and the movable arm or plate 12 that it acts to hold and stress the impact member 19, and the fail-safe assembly will remain inoperable under the normal temperature operating conditions of the electronic component or device 10, as shown at FIG. 2 of the drawings.

When, the meltable pin 20 melts due to a current overload or other condition causing an unacceptable increase in either the temperature flowing through the movable arm or plate 12 or the ambient atmosphere in the housing 11, the aligned and impact member 19 snaps and moves relative the movable arm or plate 12 until it impacts the solid surface of the wall 11*a* of housing 11, forcing the movable arm or plate 12 to open and to hold open the movable contact 16 relative the fixed contact 17 so the dangerous condition which actuated the fail-safe assembly does not reoccur, all of which is shown at FIGS. 2 and 3 of the drawings.

Impact member when used herein is intended to mean a resilient member or device that can be stressed or compressed so that when the means, such as a meltable member for stressing or compressing the impact member, softens or melts to release the impact member, the impact member will exert a relatively large force to achieve the advantageous results of the various embodiments of the present invention, as illustrated herein.

Figure 4:
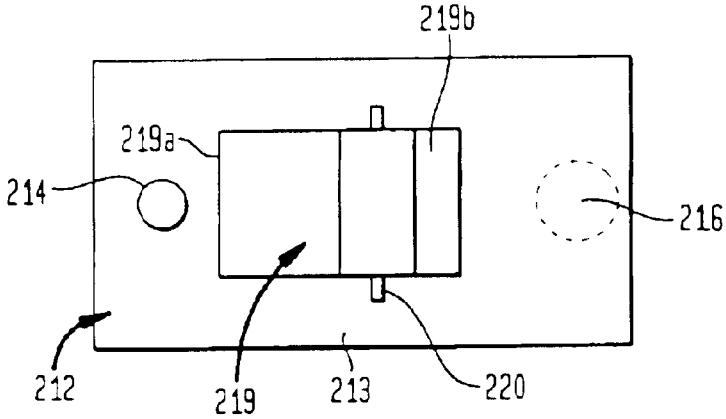
FIGS. 4, 5 and 6 show a top view and side views of a fragmentary portion of an electronic or electrical component or device including and showing another embodiment of a fail-safe assembly in accordance with the present invention wherein the stressed member is in the stressed and disengaged position and the released and engaged position.
Figure 5:
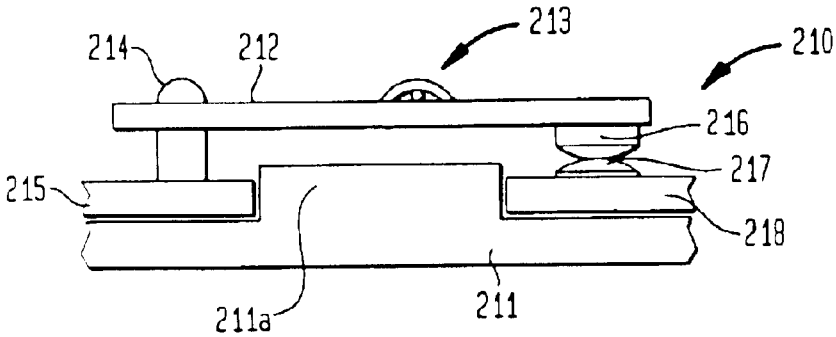
Figure 6:
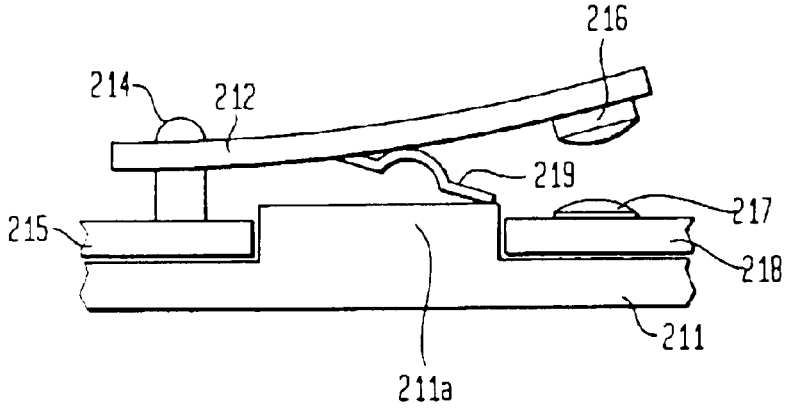

Referring to FIGS. 4, 5 and 6, a fragment of an electronic or electrical component or device generally designated 210 having a housing 211 is shown with a movable arm or plate 212 mounted therein operatively associated with another embodiment of a fail-safe assembly 213 in accordance with the present invention.

Movable arm or plate 212 is a generally elongated member identical to the movable arm or plate 12 which has been above described.

In the electronic or electrical component or device 210, the elongated movable arm or plate 212 is connected as at 214 to a first current-carrying terminal 215 connected and communicating with one side of an electrical circuit, not shown. At the end remote from the connected end 214, the movable arm or plate is provided with a contact 216 on the lower face thereof and movable with the remote end of the movable arm or plate 212 when the movable arm or plate is caused to move or bend with changes in temperature either in the plate or the ambient atmosphere in the housing 211. Elongated movable arm or plate 212 so extends through the housing 211 that in assembled position, the movable contact 216 is aligned to coact with a second or fixed contact 217 connected and mounted on a second current-carrying terminal 218 disposed a spaced distance from the first current-carrying member 215, and communicating with the opposite side of electrical circuit, not shown in which the electronic or electrical component or device 210 is connected, all of which is shown in FIGS. 4, 5 and 6.

Thus, when the movable arm or plate is caused to move or bend due to changes in temperature either in the movable arm or plate or in the ambient temperature in the housing, the movable contact 216 coacts with the fixed contact 217 to permit or stop flow of current through the electronic component or device 210.

In the event of a dangerous current overload or increase in the ambient temperature for any reason, the coacting operatively associated movable contact 216 and fixed contact 217 are caused to stick together or weld together due to arcing or other conditions common in various types of electrical circuits, then the fail-safe assembly 213 will be actuated to move and hold or latch the coacting movable contact 216 and fixed contact 217 in the open position so that current flow from the associated electrical circuit or in an associated system or apparatus will be terminated and the potential for a dangerous fire or of other damage will be avoided or terminated.

Thus, referring to FIGS. 4, 5 and 6 in this embodiment, the fail-safe assembly 213 has an elongated leaf spring impact member 219 formed integrally with and in the movable arm or plate 212 and aligned so that it will be movable relative the medial section of movable arm or plate 212. The impact member 219 has a fixed end 219*a* near the connected end 214 of the movable arm or plate 212 and a free end 219*b* remote therefrom facing the movable contact 216. The fail-safe assembly 213 includes a meltable or fusible pin 220 so connected in the medial section and transversely of the longitudinal line of the impact member 219 so that it extends into engagement with the respective opposite sides 212*a* and 212*b* of the medial section of the movable arm or plate 212 and acts to hold and stress the impact member 219 so the fail-safe assembly will remain inoperable under the normal temperature operating conditions of the electronic or electrical component or device 210, as shown at FIGS. 4 and 5 of the drawings.

When the meltable pin 220 melts due to a current overload or other condition which increases either the temperature flowing through the movable arm or plate 212 or the ambient temperature in the housing 211, the aligned and stressed impact member 219 snaps and moves relative the movable arm or plate 212 until it impacts the solid surface of the wall 211*a* of housing 211, forcing the movable arm or plate 212 to open and to hold and maintain open the movable contact 216 relative the fixed contact 217 so the dangerous condition which actuated the fail-safe assembly does not reoccur, as is shown at FIG. 6 of the drawings.

Those skilled in the art will readily recognize that alternatively the position or direction of the impact member 19 in FIGS. 1, 2 and 3 and impact member 219 in FIGS. 4, 5 and 6 can be reversed so that the fixed end of these respective impact members is near the movable contact end, and the, free end faces the connected end of the respective removable arms or plates 12 and 212 and that the operation will be the same as is described above for the illustrated embodiments at FIGS. 1, 2 and 3 and FIGS. 4, 5 and 6, without departing from the spirit and scope of the present invention.

Figure 7:
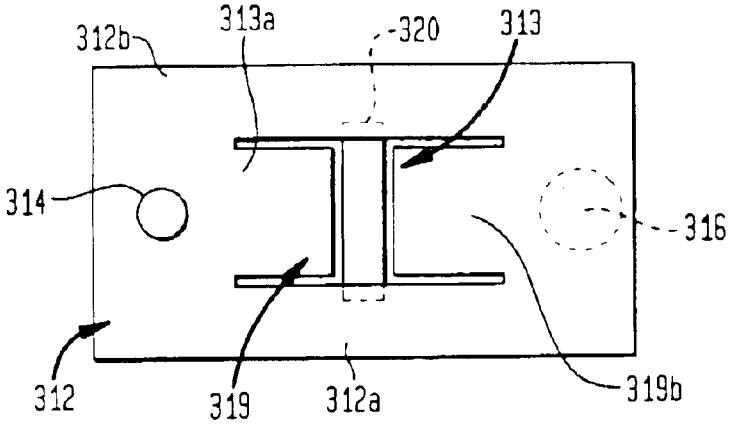
FIGS. 7, 8 and 9 show a top view and side views of a fragmentary portion of an electronic or electrical component or device showing another embodiment of a fail-safe assembly in accordance with the present invention wherein the impact member is in the stressed and disengaged position and the released and engaged position.
Figure 8:
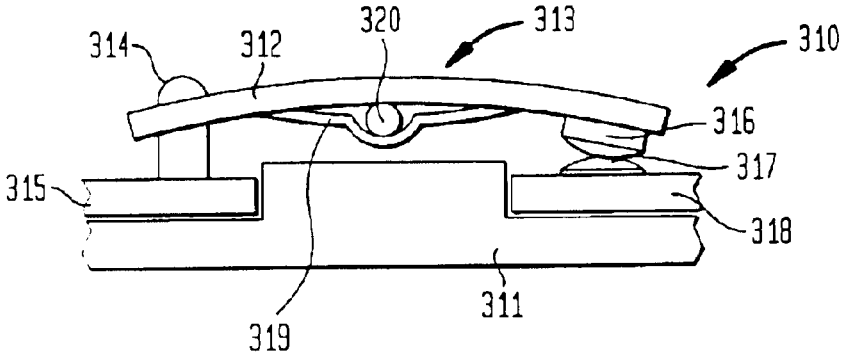
Figure 9:
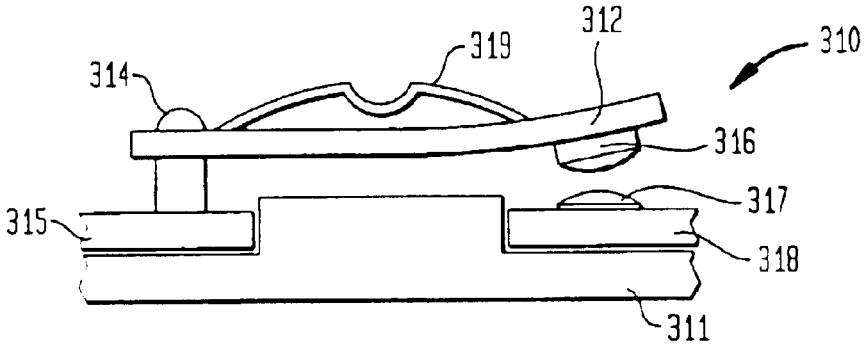

In FIGS. 7, 8 and 9, a fragment of an electronic or electrical component or device generally designated 310 having a housing 311 is shown with a movable arm or plate 312 mounted therein operatively associated with another embodiment of a fail-safe assembly 313 in accordance with the present invention.

Movable arm or plate 312 is a generally elongated member substantially similar to the movable arm or plate 12 which has been above described.

In the electronic or electrical component or device 310, the elongated movable arm or plate 312 is connected as at 314 to a first current-carrying terminal 315 connected and communicating with one side of an electrical circuit, not shown. At the end remote from the connected end 314, the movable arm or plate is provided with a contact 316 on the lower face thereof and movable with the remote end of the movable arm or plate 312 when the movable arm or plate is caused to move or bend with changes in temperature either in the plate or the ambient atmosphere in the housing 311. Elongated movable arm or plate 312 so extends through the housing 311 so that in assembled position, the movable contact 316 is aligned to coact with a second or fixed contact 317 connected and mounted on a second current-carrying member or terminal 318 disposed a spaced distance from the first current-carrying member or terminal 315, and communicating with the opposite side of electrical circuit, not shown, in which the electronic or electrical component or device 310 is connected, all of which is shown in FIGS. 7, 8 and 9.

Thus, when the movable arm or plate is caused to move or bend due to changes in temperature either in the movable arm or plate or in the ambient atmosphere in the housing, the movable contact 316 coacts with the fixed contact 317 to permit or stop flow of current through the electronic component, device 310 or an associated system or apparatus in which it is connected.

In the event of a dangerous current overload or increase in the ambient temperature for any reason, the coacting operatively associated movable contact 316 and fixed contact 317 are caused to stick together or weld together due to arcing or other conditions common in various types of electrical circuits, the fail-safe assembly 313 will be actuated to move and hold or latch the coacting movable contact 316 and fixed contact 317 into the open position so that current flow from the associated electrical circuit or in an associated system or apparatus will be terminated and the potential for a dangerous fire or of other damage will be avoided or terminated.

Thus, as shown in FIGS. 7, 8 and 9, this embodiment of the fail-safe assembly 313 has an elongated leaf spring-type impact member 319 formed integrally with and in the movable arm or plate 312 and aligned so that it will be movable relative the medial section of movable arm or plate 312. In this form of the invention, the impact member 319 is fixedly connected at one end 319*a* near the connected end 314 of the movable arm or plate 212 and at the opposite end 319*b* remote therefrom near the movable contact 316. A meltable or fusible elongated bar or pin 320 is connected in the medial section and transversely of the longitudinal line of the impact member 319 so that it extends into engagement with the respective opposite sides 312*a* and 312*b* of the medial section of the movable arm or plate 312 and acts to hold and stress the leaf spring 319 so the fail-safe assembly will remain inoperable and disengaged under the normal temperature operating conditions of the electronic or electrical component or device 10, as shown at FIG. 8 of the drawings.

When the meltable bar or pin 320 melts or fuses due to a current overload or other condition which increases either the temperature flowing through the movable arm or plate 312 or the ambient atmosphere in the housing 311, the aligned and stressed impact member 319 snaps and exerts a force which shortens and bends the movable arm or plate 312 to effectively reduce the length of the movable arm or plate 312, forcing the movable arm or plate 312 to arc and to open and hold open the movable contact 316 relative the fixed contact 317, as also shown at FIGS. 8 and 9 of the drawings.

Figure 10:
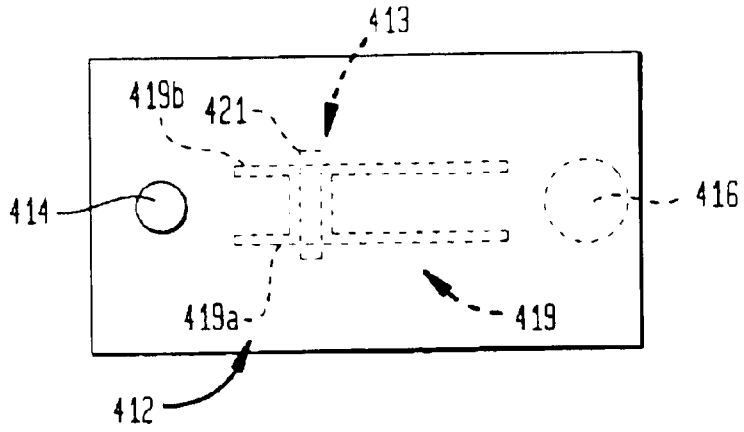
FIGS. 10, 11 and 12 show a top view and side views of a fragmentary portion of an electronic or electrical component or device including another embodiment of a fail-safe assembly in accordance with the present invention wherein the impact member is in the stressed and disengaged position and the release and engaged position.
Figure 11:
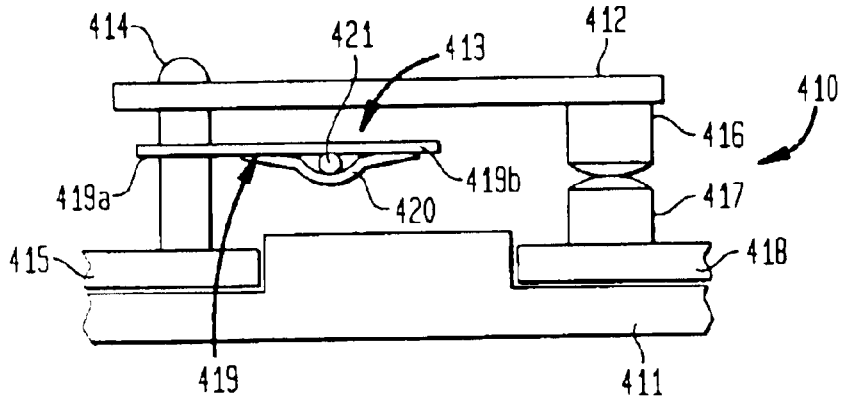
Figure 12:
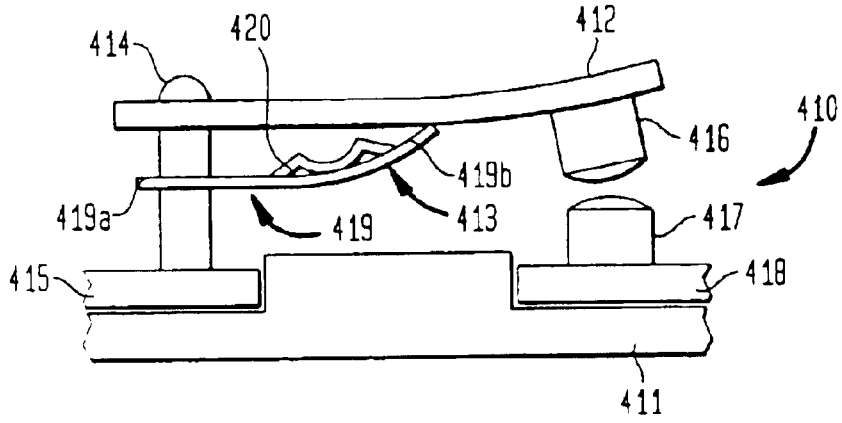

At FIGS. 10, 11 and 12, a fragment of an electronic or electrical component or device generally designated 410 having a housing 411 is shown with a movable arm or plate 412 mounted therein operatively associated with another embodiment of a fail-safe assembly 413 in accordance with the present invention.

Movable arm or plate 412 is a generally elongated member identical to the movable arm or plate 12 which has been above described.

In the electronic or electrical component or device 410, the elongated movable arm or plate 412 is connected as at 414 to a first current-carrying terminal 415 connected and communicating with one side of an electrical circuit, not shown. At the end remote from the connected end 414, the movable arm or plate is provided with a contact 416 on the lower face thereof and movable with the remote end of the movable arm or plate 412 when the movable arm or plate is caused to bend into an arc with changes in temperature either in the plate or the ambient atmosphere in the housing 411. Elongated movable arm or plate 412 so extends through the housing 411 so that in assembled position, the movable contact 416 is aligned to coact with a second or fixed contact 417 connected and mounted on a second current-carrying terminal 418 disposed a spaced distance from the first current-carrying member or terminal 415 and communicating with the opposite side of electrical circuit, not shown, in which the electronic or electrical component or device 31 is connected, all of which is shown in FIGS. 10, 11 and 12.

Thus, when the movable arm or plate is caused to move or bend due to changes in temperature either in the movable arm or plate or in the ambient atmosphere in the housing, the movable contact 416 coacts with the fixed contact 417 to permit or stop flow of current through the electronic component, device 410 or an associated system or apparatus in which it is connected.

In the event of a dangerous current overload or increase in the ambient temperature for any reason, the coacting operatively associated movable contact 416 and fixed contact 417 are caused to stick together or weld together due to arcing or other conditions common in various types of electrical circuits, the fail-safe assembly 413 will be actuated to move and hold or latch the coacting movable contact 416 and fixed contact 417 into the open position so that current flow from the associated electrical circuit or in an associated system or apparatus will be terminated and the potential for a dangerous fire or of other damage will be avoided or terminated.

Thus, as shown in FIGS. 10, 11 and 12, this embodiment of the fail-safe assembly 413 differs from the embodiments of the invention shown at FIGS. 1, 4 and 7 of the drawings in that the mechanism for holding the fail-safe assembly 413 in the stressed and non-engaged position and the released or engaged position is not formed as an integral part of the movable arm or plate 412. In this form of the invention, the fail-safe assembly 413 has a separate impact member 419 which is mounted near or adjacent to the movable arm or plate 412 so it can snap and impact the movable arm or plate 412 to open and maintain open the coacting movable contact 416 and fixed contact 417. Thus, impact member 419 is a resilient, generally elongated member which is connected in the housing at one end as at 419*a* so that the free end 419*b* extends under the lower surface of the movable arm or plate 412. An elongated resilient member 420 is formed medially in and along the longitudinal line and in the medial section of the resilient impact member 419, and an elongated meltable bar or pin 421 is held and mounted transversely to the longitudinal line of the resilient impact member 420 so that it extends into engagement with the opposite sides 419*a* and 419*b* of the impact member 419 to hold the resilient impact member 419 and the fail-safe assembly 413 in a stressed and disengaged position relative the movable arm or plate 412 so the fail-safe assembly will remain inoperable under the normal temperature operating conditions of the electronic or electrical component or device 410, as shown in FIG. 11 of the drawings.

When the meltable bar or pin 421 melts or fuses due to a current overload or other condition which increases either the temperature of the movable arm or plate 412 or the ambient atmosphere in the housing 411, the aligned and stressed impact member 419 is effectively shortened and the free end of the fail-safe assembly 413 snaps and impacts the movable arm or plate 412 to force the movable arm or plate 412 to open and to hold open the movable contact 416 relative the fixed contact 417, as is shown at FIG. 12 of the drawings.

FIGS. 13, 14A, 14B, 14C, 15, 15A, 15B and 15C show an electronic or electrical component such as a bimetallic actuated circuit breaker or device 510 having a housing 511, sized and shaped current-carrying terminals 512 and 513 mounted in said housing in predetermined spaced relation, an elongated bimetallic plate 514 is mounted thereon and still another embodiment of a fail-safe assembly 515 in accordance with the present invention, is disposed to be slidably mounted on the current-carrying terminals 512 and 513 for operative association with the bimetallic plate 514.

Bimetallic plate 514 is a generally elongated member and represents another form of the movable arm or plate 12 as above described in the embodiment of the present invention as shown at FIGS. 1, 2 and 3.

In the electronic or electrical component or device 510, the elongated bimetallic plate 514 is connected as at 516 to first current-carrying terminal 512 in turn connected and communicating with one side of an electrical circuit, not shown. At the free end remote from the connected end 516, the bimetallic plate 514 is provided with a contact 518 on the lower face thereof. Contact 518 is movable with the remote end of the bimetallic plate 514 when the movable arm or plate is caused to move or bend into an arc with changes in temperature either in the bimetallic plate or the ambient atmosphere in the housing 511. Elongated bimetallic plate 514 so extends through the housing 511 so that in assembled position, the movable contact 518 is aligned to coact with a second or fixed contact 519 connected and mounted on the second current-carrying terminal 513 communicating with the opposite side of the electrical circuit, not shown, in which the bimetallic actuated circuit breaker 510 is connected, all of which is shown in FIGS. 13, 14A, 14B, 14C, 15, 15A, 15B and 15C of the drawings.

Thus, when the movable arm or plate is caused to move or bend due to a current overload, changes in temperature either in the movable arm or plate or in the ambient atmosphere in the housing, the movable contact 518 coacts with the fixed contact 519 to permit or stop the flow of current through the electronic or bimetallic actuated circuit breaker 510 or in the system or apparatus in which the circuit breaker 510 is connected.

In the event of a dangerous current overload or increase in the ambient temperature for any reason, and the coacting operatively associated movable contact 518 and fixed contact 519 are caused to stick together or weld together due to arcing or other conditions common in various types of electrical circuits, the fail-safe assembly 515 will be actuated to move and hold or latch the coacting movable contact 518 and fixed contact 519 in the open position so that current flow from the associated electrical circuit or in an associated system or apparatus will be terminated and the potential for a dangerous fire or of other damage will be avoided or terminated.

In this embodiment of the invention, the fail-safe assembly 515 has an impact member 520 preferably made of a non-conducting material which has a generally square or rectangular block shape and is sized to fit within the housing 511 of the bimetallic actuated circuit breaker 510. In the respective opposite sides 520*a* and 520*b* of impact member 520, grooves 521 and 522 are formed which are sized to enable the impact member 520 to be slidably mounted between and on the spaced and adjacent side edges 512*a* and 513*a* of the respective first current-carrying terminal 512 and second current-carrying terminal 513. Also formed integrally on the impact member 520 and extending laterally from upper portion above the groove 522 and at the back of the side edge 520*b* is an impact wedge 523. In assembled position, the lower face of the impact wedge is flat and it has a sloping contact face 523*a* so that during sliding action of the impact member 520, the impact wedge 523 moves above the surface of the second current-carrying terminal 513, and the sloping contact face 523*a* moves into contact with the side edge 514*a* of the free end of the bimetallic plate 514 to force and move the coacting movable contact 518 and fixed contact 519 into open position and to maintain these coacting contacts in the open position, all of which is shown in FIGS. 13, 14 and 15 of the drawings.

The impact member 520 of the fail-safe assembly is actuated by a resilient element such as the coiled spring 524 which is mounted in a spring-receiving space or chamber 525 formed in the back end 526 of the impact member 520. This spring is stressed, when it is held in a compressed position, and actuation occurs when the compressive forces are released by the spring 524. Thus, when the impact member 520 is being moved into assembled position with the grooves disposed on the adjacent side edges 512*a* and 513*a* of the respective current-carrying members 512 and 513, the coiled spring 524 is mounted in the spring receiving space 525. By sliding the impact member 520 towards the back wall 511*a* of the housing 511, the coiled spring 524 can be compressed. In order to hold the impact member 520 of the fail-safe assembly in the stressed and disengaged position, a latch pin 526 made of a meltable material acts as a stop against the front end 527 of the impact member 520. Thus, in assembled position the fail-safe assembly 515 and the impact member 520 is stressed and ready but remains inactive under the normal range of temperature operating conditions for the bimetallic actuated circuit breaker or the associated system or attachment or apparatus with which this electronic component is operating.

In the event of a dangerous current overload or increase in the ambient temperature for any reason, and the coacting operatively associated movable contact 518 and fixed contact 519 are caused to stick together or weld together due to arcing or other conditions common in various types of electrical circuits, the meltable latch pin 526 will melt and release the impact member 520 of the fail-safe assembly 515, allowing compressive forces in the, coiled spring 524 to drive the slidable impact member 520 towards the bimetallic plate 514 so the sloped contact face 523*a* of impact wedge 523 will impact against the side edge 514*a* of the free end of the movable arm or plate 524 and force the bimetallic plate 514 to move and hold or latch the coacting movable contact 518 and fixed contact 519 in the open position so that current flow from the associated electrical circuit or in an associated system or apparatus will be terminated and the potential for a dangerous fire or of other damage will be avoided or terminated, all of which is shown by FIGS. 13, 14A, 14B, 14C, 15, 15A, 15B and 15C.

Figure 16:
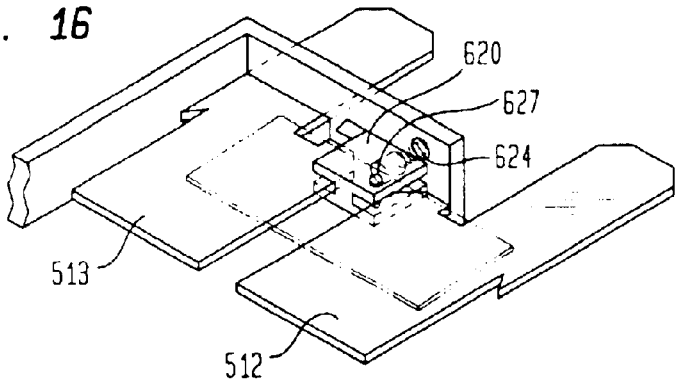
FIG. 16 is an exploded perspective view of a fragmentary portion of an electronic or electrical component or device showing the current-carrying terminals and still another embodiment of a fail-safe assembly having a slidable impact member in accordance with the present invention, wherein the impact member is in the stressed and disengaged position.
Figure 17:
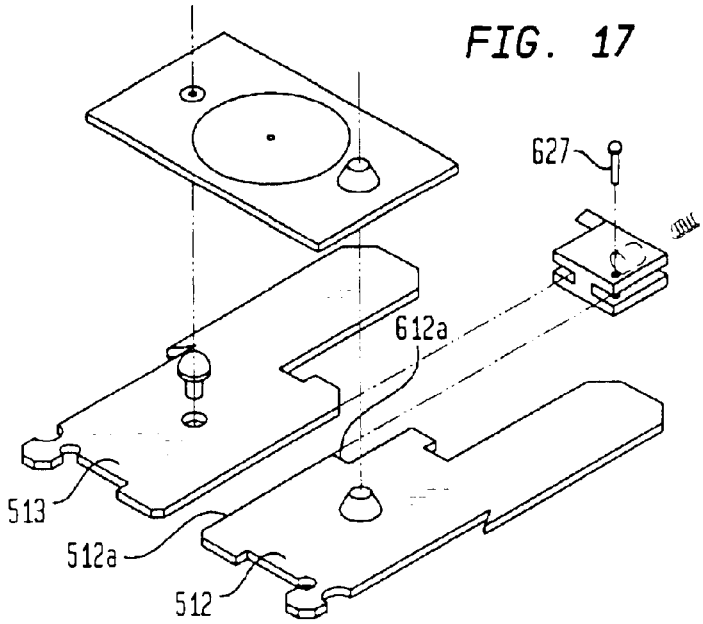
FIG. 17 is an exploded perspective view of the operatively associated terminals, contacts and current-carrying movable arm with the fail-safe assembly shown in FIG. 16 of the drawings.
Figure 18:
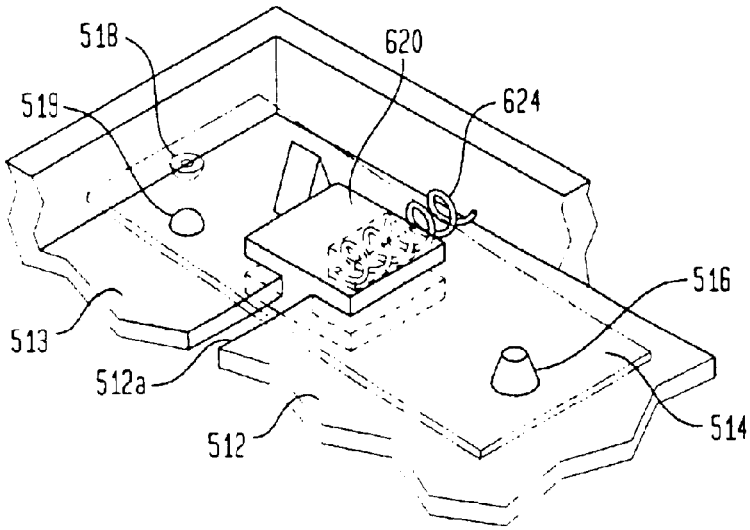
FIG. 18 is a fragmentary perspective view of the electronic or electrical component or device with the embodiment of the fail-safe assembly shown in FIG. 16 in the released and engaged position with the current-carrying movable arm for opening and maintaining open the coacting contacts of the electronic or electrical component.

FIGS. 16, 17 and 18 show another embodiment of the fail-safe assembly 615 in accordance with the present invention which differs from the form of the invention shown in the bimetallic actuated circuit breaker at FIG. 13, in that the meltable latch pin 627 is held by a stop shoulder 612*a* on the inner edge 512*a* of the current-carrying member 512 as shown at FIG. 17. When the latch pin 627 melts, the impact member 620 is slidably mounted and operatively associated with the coiled spring 624 is caused to operate in the same manner above described for the embodiment of the present invention shown in FIGS. 13, 14A, 14B, 14C, 15, 15A, 15B and 15C of the drawings. The same parts for this embodiment that are shown in this FIG. 13 have the same character numerals.

FIGS. 19 and 20 show still another embodiment of the fail-safe assembly 715 in accordance with the present invention which differs from the form of the invention shown in FIGS. 13 and 16 above described, in that the meltable latch pin 727 acts to hold the coiled spring 724 compressed. When the latch pin 727 melts, the impact member 720 is slidably mounted and operatively associated with the coiled spring 724 to operate in the same manner above described for the embodiment of the present invention shown in FIGS. 13 and 16 of the drawings.

In FIGS. 21, 22, 23, 24 and 25, a fragment of a bimetallic actuated electronic component generally designated 810 is shown having a housing 811 and a current-carrying bimetallic plate 812 mounted therein operatively associated with another embodiment of the fail-safe assembly 813 in accordance with the present invention.

Figure 21:
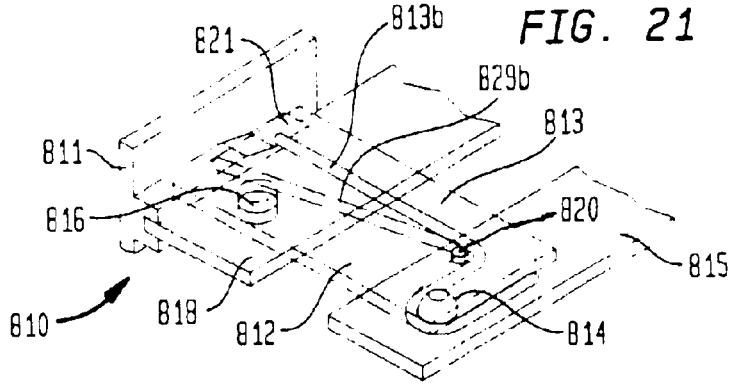
FIG. 21 is a top perspective view of a fragmentary portion of an electronic or electrical component or device including and showing still another embodiment of a fail-safe assembly in accordance with the present invention where the impact member is shown in the stressed and disengaged position in solid lines and in the released and engaged position in dotted lines.
Figure 24:
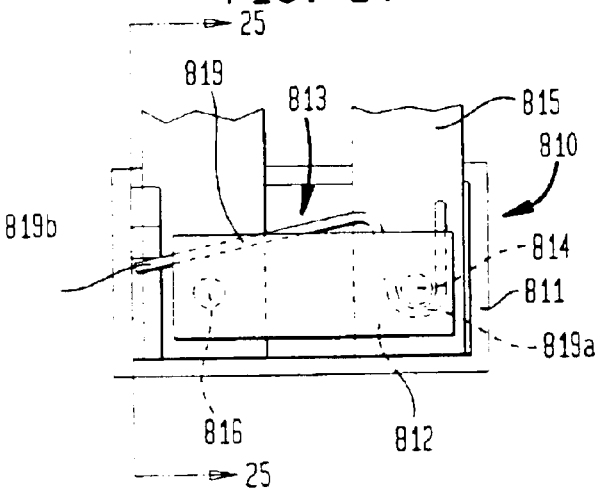
FIG. 24 is a top plan view of the fail-safe assembly shown in FIG. 21 with the impact arm in the released and engaged position relative the current-carrying member of the electronic or electrical component or device.
Figure 25:
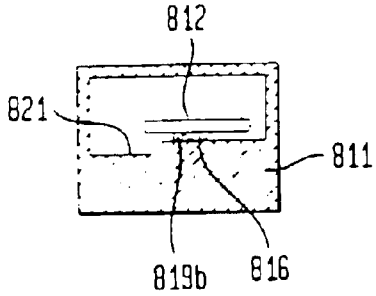
FIG. 25 is a cross-section taken on line 25—25 of FIG. 24.

In the bimetallic electronic component 810, the elongated current-carrying bimetallic plate 812 is connected as at 814 to a first current-carrying terminal 815 connected and communicating with one side of an electrical circuit, not shown. At the end remote from the connected end, the bimetallic plate 812 is provided with a contact 816 on the lower face thereof. This contact 816 is movable with the remote end of the bimetallic plate 812 when the bimetallic plate is caused to move or bend with changes in current and/or temperature either in the plate or the ambient atmosphere in the housing 811. Elongated bimetallic plate 812 so extends through the housing 11 that in assembled position the movable contact 816 is aligned to coact with a second or fixed contact 817 connected and mounted on a second current-carrying terminal 818 disposed a spaced distance from the first current-carrying member 815, and communicating with the opposite side of electrical circuit, not shown, in which the bimetallic actuated electronic component 810 is connected, all of which is shown in FIGS. 21, 22 and 24 of the drawings.

Thus, when the bimetallic plate 812 is caused to move due to changes in current and/or temperature either in the bimetallic plate or in the ambient atmosphere in the housing, the movable contact 816 coacts with the fixed contact 817 to permit or stop flow of current through the bimetallic component 810.

In the event of a dangerous current overload or increase in the exterior or interior ambient temperature for any reason, and the coacting operatively associated movable contact 816 and fixed contact 817 are caused to stick together or weld together due to arcing or other conditions common in various types of electrical circuits, the fail-safe assembly 813 will be actuated. Fail-safe assembly 813 will move and hold or latch the coacting movable contact 816 and fixed contact 817 into the open position so that current flow from the associated electrical circuit or in an associated system or apparatus will be terminated and the potential for a dangerous tire or of other damage will be avoided or terminated.

Figure 22:
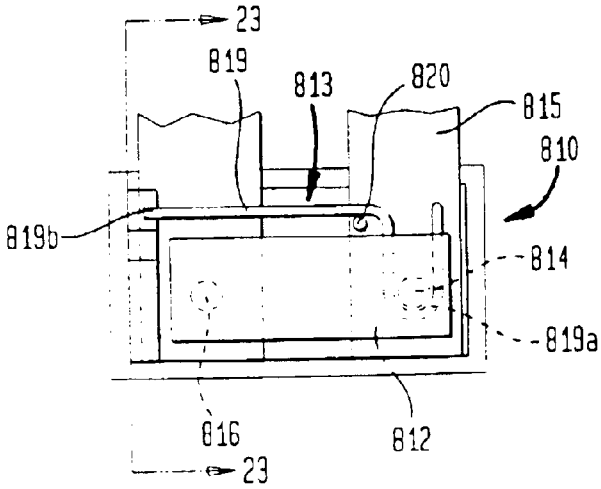
FIG. 22 is a top plan view of the fail-safe assembly shown in FIG. 21 with the impact member in the stressed and disengaged position relative the current-carrying arm of the electronic or electrical component or device.
Figure 23:
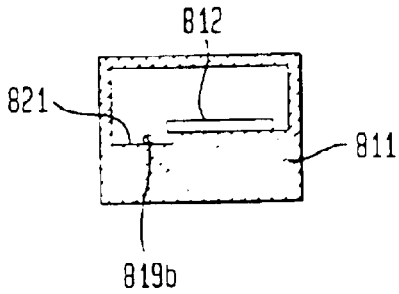
FIG. 23 is a cross-section taken on line 23—23 of FIG. 22.

Thus, referring further to FIGS. 21, 22, 23, 24 and 25 in this embodiment of the invention, fail-safe assembly 813 has an elongated wire-spring type impact member 819. The wire-spring type impact member 819 is bent into a convoluted shape so that one end as at 819*a* is fixed and the medial section 819*b* is wound about the connecting post 814 and spaced post 820. The free end 819*b* remote from the fixed end 819*a* is disposed towards the movable contact 816 and must be stressed in order for the fail-safe assembly 813 to operate for this purpose. The fail-safe assembly 813 includes a meltable pin 820 so connected relative the free impact end 819*b* of the impact member 819 and the bimetallic plate 812 that it acts to hold and stress the free impact end 819*b* of the impact member 819. In this position the fail-safe assembly 813 will remain inoperable under the normal temperature operating conditions of the bimetallic actuated electronic component 810, as shown at FIG. 22 of the drawings.

When the meltable pin 820 melts due to a current overload or other condition causing an unacceptable increase in either the temperature flowing through the bimetallic plate 12 or the ambient atmosphere in the housing 811, the impact end 819*b* of impact member 819 snaps and moves towards the bimetallic plate 812 until it encounters and slides up a ramp section 821 formed on the adjacent wall of housing 811 into engagement with the bimetallic plate 212 forcing the bimetallic plate 212 to open and to hold open the movable contact 816 relative the fixed contact 817 so the dangerous condition which actuated the fail-safe assembly does not reoccur, all of which is shown at FIGS. 21, 22, 23, 24 and 25 of the drawings.

Figure 26:
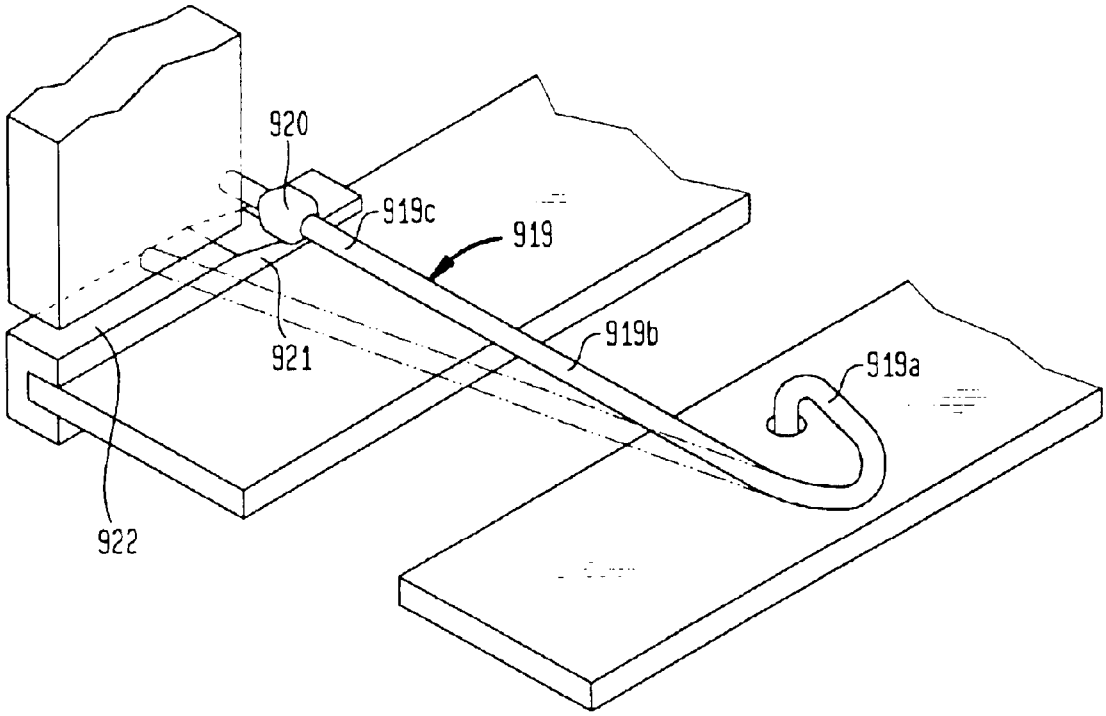
FIG. 26 is a top perspective view of a fragmentary portion of an electronic or electrical component or device including and showing still another embodiment of a fail-safe assembly in accordance with the present invention where the impact member is shown in the stressed and disengaged position in solid lines and in the released and disengaged position in dotted lines.

FIG. 26 shows another embodiment of an elongated spring-wire impact member 919 for another fail-safe assembly substantially similar to that above described for the embodiment of the fail-safe assembly shown at FIGS. 21 to 25 of the drawings.

The embodiment of the elongated spring-wire impact member 919 and the fail-safe assembly differ from the embodiment shown at FIGS. 21 to 25 in that the operatively related meltable element or device 920 is formed at the far end of the impact end 919*c* remote from the medial section 919*b* and connected end 919*a*, and a passageway at 922 formed in the ramp section 921 is so shaped and sized that the meltable element or device 920 cannot pass through the passageway. However, when the meltable element or device 920 melts, the impact end 919*c* of the spring wire impact member 919 is sized to slide through the passageway 922 to impact the bimetallic plate, not shown, and provide the same operation to open and hold open or latched the coacting contacts as in the embodiment shown at FIGS. 21, 22, 23, 24 and 25.

Figure 27:
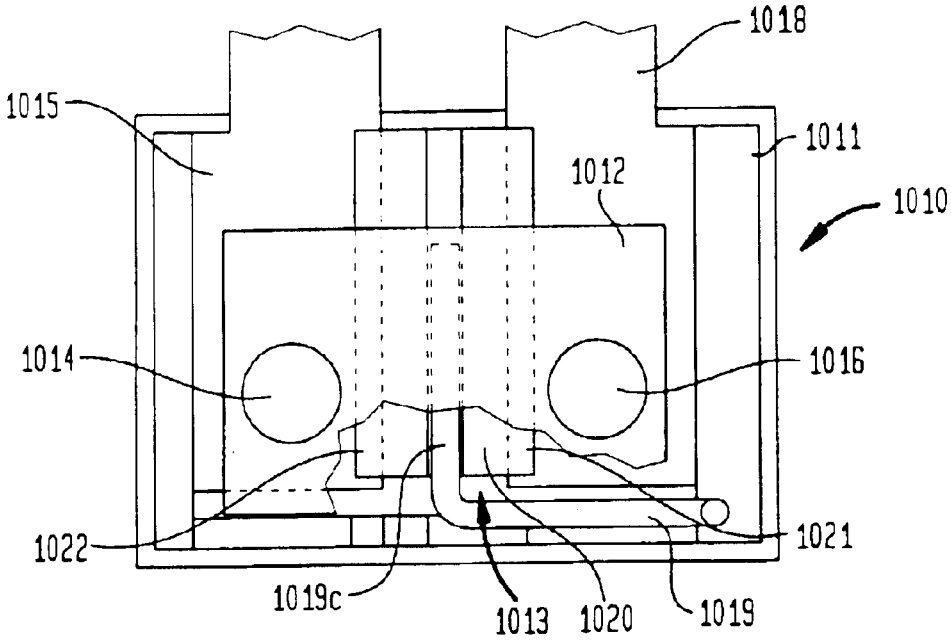
FIG. 27 is a cross-sectional view through a miniature bimetallic electronic or electrical component having a fail-safe assembly in accordance with the present invention with the impact member in the stressed and disengaged position and showing a visual signal assembly.
Figure 28:
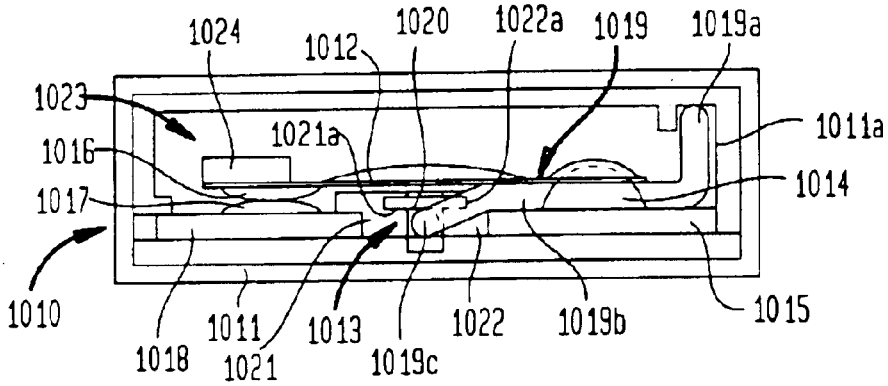
FIG. 28 is a cross-section taken on line 28—28 of FIG. 27.
Figure 29:
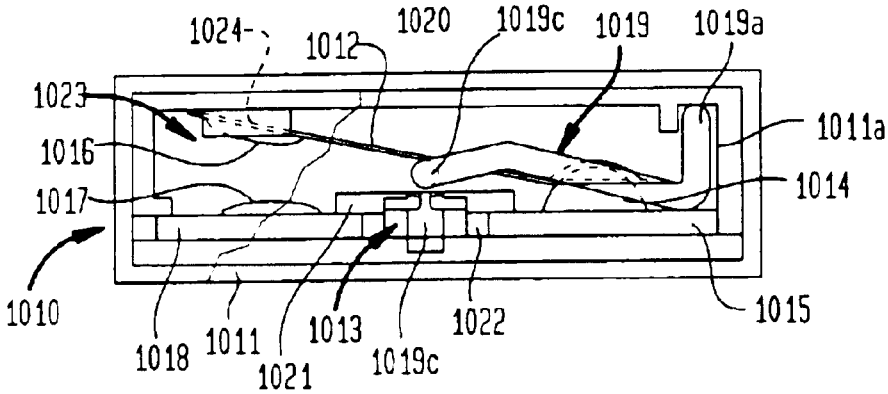
FIG. 29 is the same cross-section shown in FIG. 28 with the impact member of the fail-safe assembly in the released and engaged position and the visual signal assembly signaling that the fail-safe assembly has been activated.

Referring to FIGS. 27, 28 and 29, another bimetallic actuated electronic component generally designated 1010 is shown which is adapted to provide a miniature circuit breaker for an associated electrical device, system or apparatus, not shown.

Bimetallic actuated electronic component 1010 has a housing 1011 and a current-carrying bimetallic plate 1012 mounted therein for operative association with another embodiment of fail-safe assembly 1013 in accordance with the present invention.

In the bimetallic actuated electronic device 1010, the elongated bimetallic plate 1012 is connected as at 1014 to a first current-carrying terminal 1015 connected and communicating with one side of an electrical circuit, not shown. At the end remote from the connected end 1014, the bimetallic plate is provided with a contact 1016 on the lower face thereof and movable with the remote end of the bimetallic plate 1012 when the bimetallic plate is caused to move or bend with changes in temperature either in the plate or the ambient atmosphere in the housing 1011. Elongated bimetallic plate 1012 so extends through the housing 1011 that in assembled position, the movable contact 1016 is aligned to coact with a second or fixed contact 1117 connected and mounted on a second current-carrying terminal 1018 disposed a spaced distance from the first current-carrying member 1015, and communicating with the opposite side of electrical circuit, not shown, in which the electronic or electrical component or device 1010 is connected, all of which is shown in FIGS. 27, 28 and 29.

Thus, when the bimetallic plate is caused to move or bend due to changes in temperature either in the bimetallic plate or in the ambient temperature in the housing, the movable contact 1016 coacts with the fixed contact 1017 to permit or stop flow of current through the bimetallic actuated electronic component or device 1010 and/or the associated apparatus or system.

Thus, referring to FIGS. 27, 28 and 29 in this embodiment, the fail-safe assembly 1013 includes an elongated, convoluted and shaped wire spring impact member 1019 which has one end fixedly connected as at 1019*a* into a section 1011*a* formed on the inner surface of a side wall of the housing 1011.

Wire spring impact member 1019 has an intermediate section 1019*b* which extends transversely through the housing 1011 and continuous with the intermediate section 1019*b* at the end remote from the connected end a free or impact end 1019*c* which, because of the resilient and convoluted characteristics of the wire spring impact member 1019, can be held in the desired highly stressed position by meltable or fusible member 1010. Meltable or fusible member 1020 acts under normal operating temperatures for the bimetallic actuated electronic component 1010 to prevent or restrain the stressed and resilient impact end 1019*b* of impact member 1019 from releasing and expanding into operative engagement with the bimetallic plate 1010 which extends and overlies the area where the fail-safe assembly 1013 is disposed in the housing 1011.

Generally T-shaped members as at 1021 and 1022 are formed and connected on the back wall of the housing 1011 in spaced relation to each other to define on each of their respective inner and adjacent side faces a first mounting guide 1021*a* on T-shaped member 1021 and a second mounting guide 1022*a* on T-shaped member 1022. The generally T-shaped members 1021 and 1022 are so spaced that the free or impact end 1019*c* of impact member 1019 can, when not restrained by the meltable or fusible member 1020, move freely into engagement with the bimetallic plate 1012. The meltable or fusible member is generally elongated, planar, rectangularly shaped and so sized that it will slide between, into and be held in functional engagement in the mounting grooves 1021*a* and 1022*a* in the respective generally T-shaped members 1021 and 1022.

Thus, when the meltable or fusible member 1020 melts due to a current overload or other advise condition which increase the temperature flowing through the bimetallic plate 1012 or the ambient temperature in the housing 1011, the confined, restrained and stressed impact end 1019*c* of the impact member 1019 will snap, spring and move through the space between the generally T-shaped members 1021 and 1022 and impact and move into non-releasable engagement with the bimetallic plate 1012, forcing the bimetallic plate to open and to hold and maintain open the movable contact 1016 relative the fixed contact 1017 to terminate flow of current and operation of the bimetallic actuated electronic component and/or the associated systems or apparatus to which it is connected so the dangerous condition which actuated the fail-safe assembly 1013 does not reoccur until the dangerous condition is rectified, all of which is shown at FIGS. 27, 28 and 29 of the drawings.

In the bimetallic actuated electronic component 1010 and this embodiment of the fail-safe assembly 1013, a visual signal assembly generally designated 1023 is provided so that the released or engaged position of the fail-safe assembly 1013 will be visible at the exterior of the electronic component where the fail-safe assembly has been actuated.

The visual signal assembly 1023 provides at least one signal member 1024 which is connected at the movable contact end of the bimetallic plate 1012 and therefor moves with the bimetallic plate 1012. Signal indicator or member 1024 is an elongated planar member disposed normal to the bimetallic plate 1012 and will have a color such as silver, white, red or the like so that it will be visible when the fail-safe assembly 1013 is actuated in response to a dangerous condition through a viewing window 1025 in the wall of the housing 1011.

While this embodiment of the visible signal assembly 1023 has been illustrated, those persons skilled in the art will recognize that the signal indicator or member can be placed on, for example, the wire spring member 1019 to coact with a viewing window or to activate a slidable member which slides to the exterior of the electronic component so it will be visible through a viewing window, without departing from the scope or spirit of this feature of the present invention.

Figure 30:
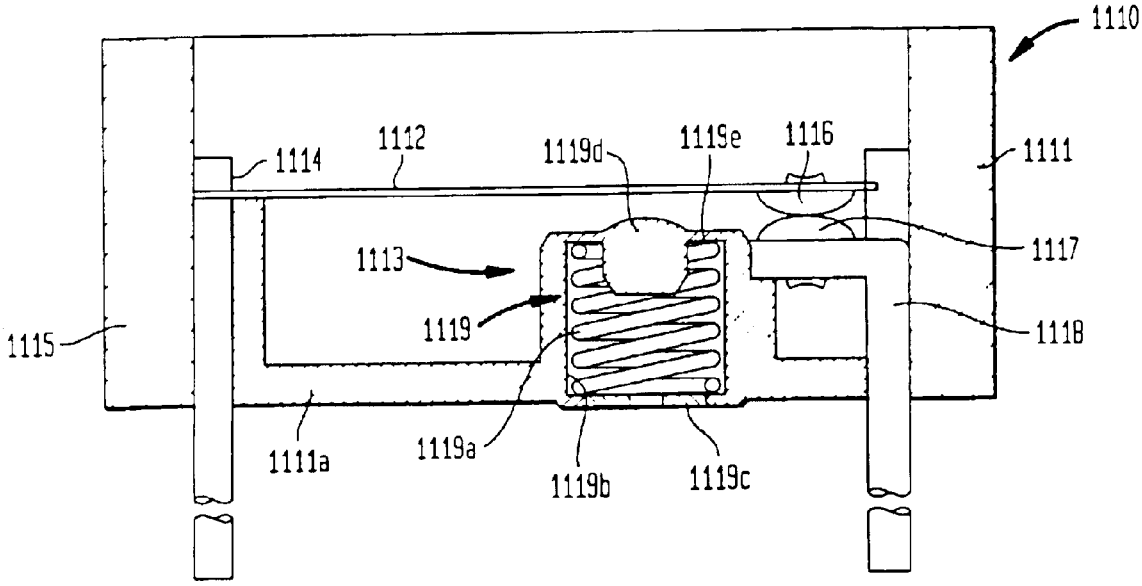
FIG. 30 is a cross-section of a fragment of an electronic or electrical component or device with still another embodiment of the fail-safe assembly in accordance with the present invention having the impact member in the stressed and disengaged position relative the current-carrying movable arm of the electronic or electrical component or device.
Figure 31:
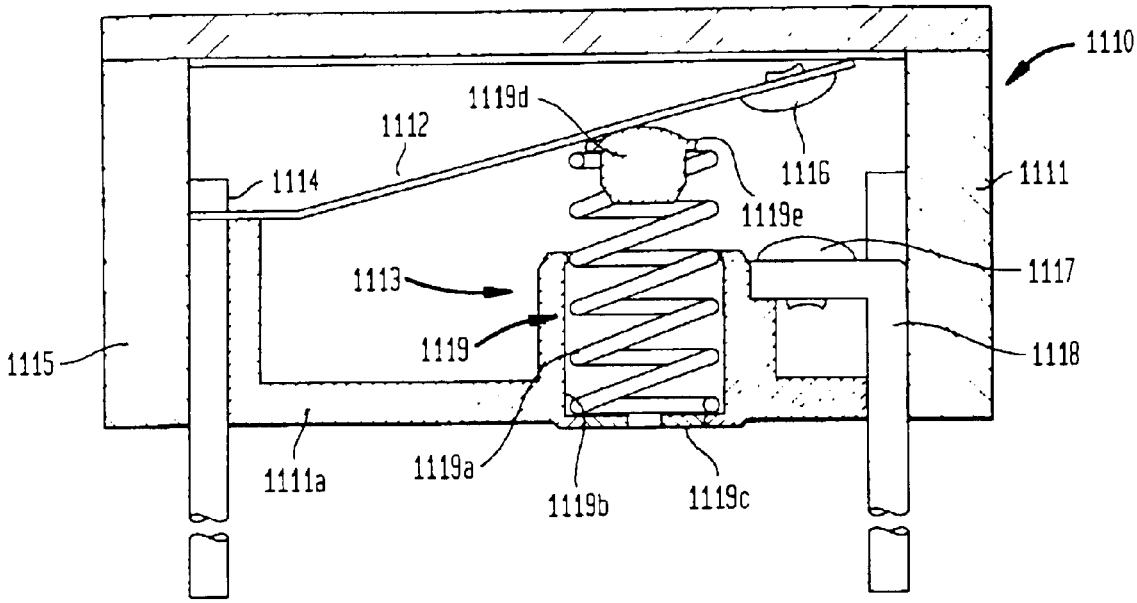
FIG. 31 is the same cross-section shown in FIG. 30 with the impact member in the released and engaged position relative the current-carrying movable arm.

In a still further illustration of the present invention, FIGS. 30 and 31 show a fragment of an electronic component generally designated 1110 having a housing 1111 with a current-carrying movable arm or plate 1112 mounted therein for operative association with a still further embodiment of the fail-safe assembly 1113 in accordance with the present invention.

This embodiment of the fail-safe assembly differs from the earlier embodiments in that the meltable or fusible member is formed as part of the housing or wall or other structure of the electronic or electrical component with which the fail-safe assembly is operatively associated.

Movable arm or plate 1112 is a generally elongated member substantially similar to the movable arm or plate 12 which has been above described.

In the electronic or electrical component or device 1110, the elongated movable arm or plate 1112 is connected as at 1114 to a first current-carrying terminal 1115 connected and communicating with one side of an electrical circuit, not shown. At the end remote from the connected end 1114, the movable arm or plate is provided with a contact 1116 on the lower face thereof and movable with the remote end of the movable arm or plate 1112 when the movable arm or plate is caused Do move or bend with charges in temperature either in the plate or the ambient atmosphere in the housing 1111. Elongated movable arm or plate 1112 so extends through the housing 1111 that in assembled position, the movable contact 1116 is aligned to coact with a second or fixed contact 1117 connected and mounted on a second current-carrying member or terminal 1118 disposed a spaced distance from the first current-carrying member or terminal 1115, and communicating with the opposite side of electrical circuit, not shown, in which the electronic or electrical component or device 110 is connected, all of which is shown in FIGS. 30 and 31.

Thus, when the movable arm or plate 1112 is caused to move or bend due to changes in temperature either in the movable arm or plate or in the ambient atmosphere in the housing, the movable contact 1116 coacts with the fixed contact 1117 to permit or stop flow of current through the electronic component, device 1110 or an associated system or apparatus in which it is connected.

In the event of a dangerous current overload or increase in the ambient temperature for any reason, the coacting operatively associated movable contact 1116 and fixed contact 1117 are caused to stick together or weld together due to arcing or other conditions common in various types of electrical circuits, the fail-safe assembly 1113 will be actuated to move and hold or latch the coacting movable contact 1116 and fixed contact 1117 into the open position so that current flow from the associated electrical circuit or in an associated system or apparatus will be terminated and the potential for a dangerous fire or of other damage will be avoided or terminated.

Thus, as shown in FIGS. 30 and 31 in this embodiment of the fail-safe assembly 1113, there is an impact assembly 1119 which includes a coiled spring 1119*a* which is mounted in the spring recess 1119*b* formed in the lower wall 1111*b* of the housing 1111 at a point which faces the lower face of the movable arm or plate 1112. The lower section 1119*c* of the spring recess 1119*b* may be a fixed or removable section for engagement with the lower end of the coiled spring 1119*a*. The coiled spring 1119*a* is held in the spring recess 1119*b* by an impact member 1119*d* which engages the upper face of the coiled spring 1119*a* so that it will be held in a compressed or stressed position until it is released.

The impact member 1119*d* is connected by a section 1119*e* formed as part of the upper end of the formed spring recess 1119*b* in the lower section 1111*a* of the housing 1111. Section 1119*e* will be made of a meltable or fusible material, such that the fail-safe assembly 1113 will remain inoperable and disengaged under the normal operating conditions of the electronic or electrical component 1110, as shown at FIG. 30 of the drawings.

When the connecting section 1119*e* softens, melts or fuses due to a current overload or other adverse condition which increases either the temperature flowing through the movable arm or plate 1112 or the ambient condition in housing 1111, the stressed coiled spring 1119*a* exerts a force against impact member 1119*d* which causes it to impact against the lower face of the movable arm or plate 1112 to open and to hold open the movable contact 1116 relative the fixed contact 1117, so that current flow from the electrical circuit or in an associated system or apparatus will be terminated and the potential for a dangerous fire or other damage will be avoided or terminated.

In each of the embodiments, the basic operation requires that the resilient impact element or assembly be restrained and stressed and remain in this condition until the meltable or fusible material melts, at which time the restrained end of the resilient impact element moves the available distance from the restrained, stressed and disengaged position to the released, unstressed and engaged position, exerting the force necessary to move the coacting contacts in the electrical or electronic component, device, system or apparatus to the open position and to maintain them in the open position to protect against the dangerous conditions for which the fail-safe assembly is being used.

The forces that can or must be exerted to achieve this basic operation can be adjusted or altered because the various embodiments of the present invention allow for a wide range of function and design parameters.

For example, a more powerful impact force can be obtained on release of the restrained or stressed end of the impact member by using a heavier cross-section and by increasing the actual distance the impact end of the impact member travels from the stressed to the unstressed position. However, the converse of these design changes is that the meltable or fusible materials will have to be adjusted as a function of their melting point.

In the various embodiments of the fail-safe assembly, the resilient impact member is preferably some form of spring-tempered alloy, whether in leaf form, wire form or coiled spring form. Numerous such alloys are readily available in the commercial marketplace. The selection of a given spring-tempered material or alloy will depend on the configuration, proportion and size of the impact forces to be generated and the travel available or needed within the size constraints of the electronic or electrical component, device, system or apparatus in which the fail-safe assembly will be used.

Similarly, in regard to the meltable or fusible member, there are many alloys, plastic resin materials as well as changes in the thickness, shape and connecting position of the illustrated meltable or fusible members. For example, in addition to the actual materials selected, the temperature at which the meltable or fusible member will soften or melt can be adjusted by the thickness or mass of the member.

Thus, the present invention, as illustrated by the multiple embodiments, provides a wide range of variables to provide an accurate, repeatable method of providing a lowcost, built-in fail-safe assembly for the coacting contacts in electronic or electrical components, devices, systems and apparatuses.

While the foregoing description of the illustrated figures of the drawings are directed to the preferred embodiment in accordance with the present invention, those skilled in the art will appreciate that numerous modifications can be made to the various aspects of the illustrated embodiments. Indeed, such modifications are encouraged by the foregoing description as to the materials, structure and arrangements of the disclosed embodiments without departing from the spirit and scope thereof. Thus, the foregoing description of such preferred embodiments should be taken by way of illustration rather than by way of limitation with respect to the present invention which is defined by the appended claims.

What is claimed is:

1. A fail-safe assembly for any electrical component, device, system and apparatus having coacting contacts to enable the flow of electrical current therethrough comprising a resilient impact assembly having an impact section disposed for movement from a stressed and disengaged position to impact and engage at least one of said coacting contacts to open and maintain the coacting contacts open for stopping the flow of electrical current, and a meltable member for holding the impact end of the impact member in the stressed and disengaged position under normal operating electrical current flow and temperature conditions of said electrical component, device, system and apparatus and to melt and release the impact end of the impact member to terminate electrical current flow when current overload and temperature changes create a dangerous condition therein.

2. A fail-safe assembly for any electrical component, device, system and apparatus having coacting contacts and a current-conducting movable arm for opening and closing said coacting contacts to enable electrical current to flow therethrough comprising:

a. an impact assembly including a resilient impact section, b. said impact section disposed for movement from a stressed and disengaged position and movable to impact and so engage said movable arm to open and maintain open the coacting contacts for stopping the flow of electrical current, and c. a meltable member for holding the impact section in the stressed and disengaged position under normal operating electrical current flow and temperature conditions of said electrical component, device, system and apparatus and to melt and release the impact section of the impact member to terminate electrical current flow when current overload and temperature changes create a dangerous condition.

3. A fail-safe assembly as in claim 1 or 2 wherein at least a portion of the resilient impact section is in the form of a leaf spring.

4. A fail-safe assembly as in claim 1 or 2 wherein the resilient impact section is a spring wire-type member.

5. A fail-safe assembly as in claim 1 or 2 wherein the resilient impact section includes a coiled wire-type member.

6. A fail-safe assembly as in claim 2 wherein the resilient impact section is formed integrally with the movable arm.

7. A fail-safe assembly as in claim 2 wherein the impact member is independent of and disposed for operable engagement with said movable arm for opening and maintaining open the coacting contacts.

8. In the fail-safe assembly as in claim 1 or 2 including visual signal means for signaling that the fail-safe assembly has been actuated.

9. In the fail-safe assembly as in claim 2 including a signal tab on the movable arm and a viewing window on the electrical component, device, system and apparatus for operative association with the signal tab to show that the fail-safe assembly has been actuated.

10. Fail-safe assembly as claimed in claim 1 or 2 wherein (a) the impact member is slidably mounted for non-contacting movement towards and away from the movable arm, (b) said impact member having an impact wedge thereon disposed on movement of said impact member to engage said movable arm to open and maintain open the coacting contacts for stopping the flow of electrical current, and (c) a meltable member for holding the impact section in a stressed and disengaged position under normal operating electrical current flow and temperature conditions of said electrical component, device, system and apparatus and to melt and release the impact section of the impact member when current overload and temperature conditions create a dangerous condition.

11. In the fail-safe assembly as in claim 10 wherein the meltable member defines a stop element in engagement with the front end of the impact member when the impact member is in the stressed and disengaged position.

12. In the fail-safe assembly as in claim 10 wherein the meltable member is mounted through the impact member and disposed for engagement with a stop shoulder formed in the electrical component, device, system and apparatus.

13. In the fail-safe assembly as in claim 10 wherein the impact member includes a coiled spring, and the meltable member is disposed to hold the coiled spring so the impact member will remain in the stressed and disengaged position during normal operation of the electrical component, device, system and apparatus, and on melting of the meltable member, will enable the coiled spring to release the impact member when current overload and temperature conditions create a dangerous condition.

14. In the fail-safe assembly as in claim 1 or 2 wherein the resilient impact member is made at least in part from materials from the group of spring alloys in leaf form, wire form and coil spring form.

15. In a fail-safe assembly as in claim 14 wherein the impact force exerted by the resilient impact member is adjustable, by varying the thickness and length of the resilient impact member.

16. In a fail-safe assembly as in claim 1 or 2 wherein the meltable member is made from materials from the group of metal alloys and plastic resins adapted to soften and melt at a predetermined temperature.

17. In a fail-safe assembly as in claim 16 wherein the meltable member melting point is adjustable by varying the thickness and mass of the formed meltable member.

18. The combination of an electronic component, device, system and apparatus having a first contact connected to a first current-carrying terminal and a second contact spaced from said first contact connected to a second current-carrying terminal in spaced relation to said first current-carrying terminal and a current-carrying movable arm connected to said first current-carrying terminal and having said first contact mounted thereon for coaction with the second contact with a fail-safe assembly comprising:

a. an impact assembly including a resilient impact section, b. said impact section disposed for movement from a stressed and disengaged position and movable to impact and so engage said movable arm to open and maintain open the coacting contacts for stopping the flow of electrical current, and c. a meltable member for holding the impact section in the stressed and disengaged position under normal operating electrical current flow and temperature conditions of said electrical component, device, system and apparatus and to melt and release the impact section of the impact member when current overload and temperature conditions create a dangerous condition.

19. In the combination as in claim 18 wherein at least a portion of the resilient impact section is in the form of a leaf spring.

20. In the combination as in claim 18 wherein the resilient impact member is a spring wire-type member.

21. In the combination as in claim 18 wherein the resilient impact member includes a coiled wire-type member.

22. In the combination as in claim 18 wherein the resilient impact member is formed integrally with the movable arm.

23. In the combination as in claim 18 wherein the resilient impact section is made at least in part from materials from the group of spring alloys in leaf form, wire form and coil spring form.

24. In the combination as in claim 23 wherein the impact force exerted by the resilient impact member is adjustable by varying the thickness and length of the resilient impact member.

25. In the combination as in claim 18 wherein the meltable member is made from materials from the group of metal alloys and plastic resins adapted to soften and melt at a predetermined temperature.

26. In the combination as in claim 25 wherein the meltable member melting point is adjustable by varying the thickness and mass of the formed meltable member.

27. In the combination as in claim 18 wherein:

(a) the impact assembly is slidably mounted on and between the first current-carrying terminal and the second current-carrying terminal and movable from a disengaged to an engaged position relative the movable arm;

(b) said impact assembly has an impact wedge disposed for engagement with the movable arm when the impact assembly is moved to the engaged position; and (c) a meltable member for holding the impact assembly in the disengaged position under normal operating electrical current flow and temperature conditions of such electrical components, devices, systems and apparatus and to soften, melt and release the impact assembly to bring the impact wedge into engagement with the movable arm to open and maintain open the coacting contacts so as to terminate electrical current flow when current overload and temperature changes create a dangerous condition.

28. The combination as in claim 27 wherein the meltable member acts as a stop when the impact member is moved to the disengaged position and holds the resilient member in the stressed condition.

29. The combination as in claim 27 wherein the meltable member extends through the front section of the impact member and engages a stop shoulder formed on the first current-carrying terminal.

30. The combination as in claim 27 wherein the resilient member is disposed in the impact member and the meltable member extends through the impact member to hold the resilient member in the stressed condition during normal operating conditions of the electrical component, device, system and apparatus.

31. In the combination as in claim 18 having a housing and wherein:

(a) the impact member is connected to an integral section of the housing made of a meltable material normally holding the impact member in a disengaged position relative the movable arm;

(b) said integral section including a resilient member space and the resilient member disposed in said resilient space and stressed in assembled position by said impact member; and (c) said meltable integral section of the housing to soften and melt at a predetermined temperature to release the resilient member for driving the impact member into engagement with the movable arm so as to open and maintain open the coacting movable contact and fixed contact when a current overload and temperature changes cause a dangerous condition in the electrical component, device, system and apparatus.

32. In the combination as in claim 31 wherein the resilient member is made from the group of spring alloys in a coiled spring form.

33. In the combination as in claim 31 wherein the meltable integral section of the housing is from a group of metal alloys and plastic materials adapted to melt at a predetermined temperature.

34. In the combination as in claim 31 wherein the impact force exerted by the impact member is adjustable as a function of the mass and length of movement of the impact member.

* * * * *